US005823217A

United States Patent [19]

Rice

[11] Patent Number: 5,823,217

[45] Date of Patent: Oct. 20, 1998

[54] SUNSHADE

[75] Inventor: Paul Rice, Palo Alto, Calif.

[73] Assignee: GreenBest, Inc., Palo Alto, Calif.

[21] Appl. No.: 630,737

[22] Filed: Apr. 10, 1996

[51] Int. Cl.[6] ..... E04H 15/34

[52] U.S. Cl. ..... 135/124; 135/137; 135/138; 135/900; D30/118; D30/108

[58] Field of Search ..... 135/125, 127, 135/128, 139, 143, 116, 120.1, 900, 904, 137

[56] References Cited

U.S. PATENT DOCUMENTS

| | | | |
|---|---|---|---|
| D. 264,613 | 5/1982 | Moss . | |
| D. 266,178 | 9/1982 | Lotterer . | |
| D. 304,966 | 12/1989 | Eppenbach . | |
| D. 362,363 | 9/1995 | Friedman . | |
| D. 374,512 | 10/1996 | Kiley et al. | 135/137 X |
| 2,190,566 | 2/1940 | Julian . | |
| 2,193,469 | 3/1940 | Ashton | 135/125 X |
| 2,290,786 | 7/1942 | Varady | 135/143 X |
| 2,531,501 | 11/1950 | Cline . | |
| 2,543,597 | 2/1951 | Peery . | |
| 2,543,684 | 2/1951 | Blanchard | 135/125 X |
| 2,652,845 | 9/1953 | O'Neill et al. | 135/120.1 X |
| 2,853,086 | 9/1958 | Biagosch . | |
| 2,886,047 | 5/1959 | Healy . | |
| 3,042,053 | 7/1962 | Gabriel . | |
| 3,052,249 | 9/1962 | Seaman et al. | 135/125 |
| 3,255,467 | 6/1966 | Kowalski . | |
| 3,405,721 | 10/1968 | Crosier et al. . | |
| 3,431,923 | 3/1969 | Klepac . | |
| 3,759,277 | 9/1973 | Glade . | |
| 3,800,814 | 4/1974 | Hibbert | 135/125 X |
| 3,834,410 | 9/1974 | Leibel | 135/127 X |
| 3,847,170 | 11/1974 | Anderson | 135/143 X |
| 3,906,968 | 9/1975 | Black . | |
| 3,970,096 | 7/1976 | Nicolai | 135/127 X |
| 4,585,020 | 4/1986 | Masuda et al. . | |
| 4,599,754 | 7/1986 | Mairs, III et al. . | |
| 4,606,070 | 8/1986 | Schachter . | |
| 4,612,948 | 9/1986 | Simpson . | |
| 4,639,958 | 2/1987 | Lerner . | |
| 4,646,770 | 3/1987 | Lobato . | |
| 4,719,934 | 1/1988 | Mydans . | |
| 4,739,784 | 4/1988 | Fast . | |
| 4,790,340 | 12/1988 | Mahoney . | |
| 4,865,066 | 9/1989 | Brooks . | |
| 4,930,534 | 6/1990 | Hill . | |
| 4,979,531 | 12/1990 | Toor et al. . | |
| 4,981,152 | 1/1991 | Laurent . | |
| 5,080,123 | 1/1992 | Stein | 135/900 X |
| 5,159,947 | 11/1992 | Chuang et al. . | |
| 5,230,358 | 7/1993 | Forell . | |
| 5,273,142 | 12/1993 | Weber . | |
| 5,546,971 | 8/1996 | Leonhardt | 135/127 |

FOREIGN PATENT DOCUMENTS

| | | | |
|---|---|---|---|
| 0859919 | 1/1941 | France | 135/125 |
| 1477376 | 3/1967 | France | 135/125 |
| 0766312 | 1/1957 | United Kingdom | 135/125 |

*Primary Examiner*—Lanna Mai

*Attorney, Agent, or Firm*—Burns, Doane, Swecker & Mathis, L.L.P.

[57] ABSTRACT

The SUNSHADE according to the present invention includes a floor and a canopy attached to the floor which extends over the floor for protecting the occupants from sun and wind. The canopy and the floor are connected to each other along one end. The SUNSHADE also includes a self supporting support structure which includes two long flexible support rods and one or more, preferably three, shorter cross rods attached to the flexible support rods. The flexible support rods connected by the cross rods form an arch shape which supports the canopy in tension. The SUNSHADE according to the present invention addresses the disadvantages of the prior art by providing a sun and wind shelter which does not require attachment by stakes to the ground and which may be collapsed into a lightweight and compact configuration for carrying.

12 Claims, 2 Drawing Sheets

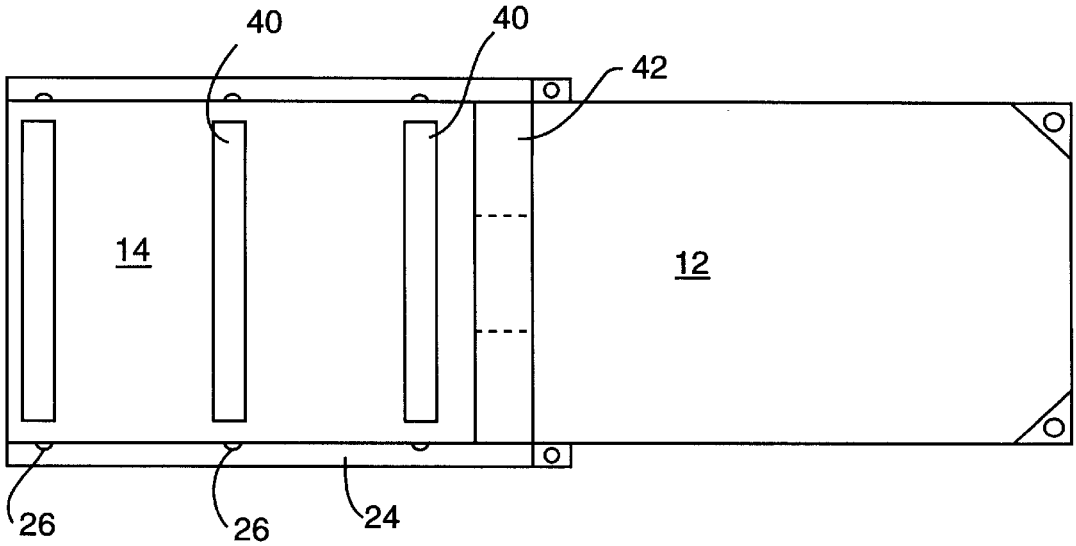
FIG. 5
FIG. 3
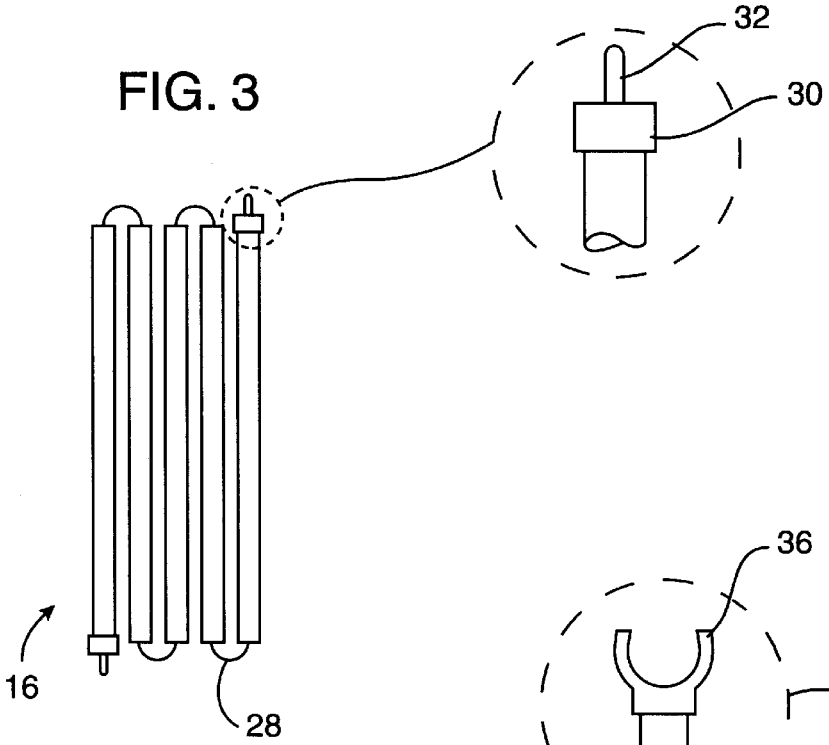
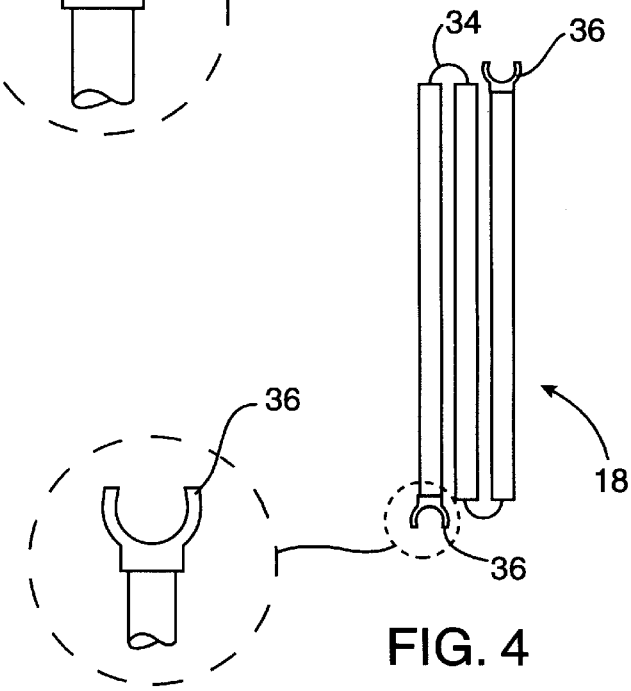
FIG. 4

SUNSHADE

BACKGROUND OF THE INVENTION

1. Field of the Invention

The present invention relates to a collapsible, transportable, lightweight shelter, and more particularly, to a SUNSHADE which can be used outdoors to protect a user from the sun and wind.

2. Description of the Related Art

Many different shelter structures have been developed for protecting users from sun and/or wind at the beach. These shelter structures are sometimes combined with a beach blanket or floor which the user may lay on to avoid coming into direct contact with the sand. However, beach blankets tend to be blown about by the wind if they are not securely anchored to the sand. In an attempt to address this problem, devices such as the screen disclosed in U.S. Pat. No. 4,599,754 have been used to anchor a beach blanket to the sand. This blanket includes holes through which posts of a wind screen may be inserted to pin the beach blanket corners to the sand.

Various other sun and wind shelters are disclosed, for example, by U.S. Pat. Nos. 2,190,566, 3,255,467, 4,739,784, and 4,646,770. These patents show various canopy structures which must be secured to the ground by stakes in order to be held in a desired position. The need for stakes to secure these structures is a distinct drawback of these sun and wind shelters, particularly in areas where the sand is particularly soft or on rocky beaches where it will be difficult to successfully secure the stakes in the ground.

Additional sun and wind shelters are disclosed by U.S. Pat. Nos. D362,363, D266,178 and 4,865,066. These shelter structures include interengaging poles and posts which are self supporting, however, the substantial number and size of the structural members required to make these shelters self supporting also makes them cumbersome and heavy to transport.

SUMMARY OF THE INVENTION

The device according to the present invention addresses the disadvantages of the prior art by providing a sun and wind shelter which does not require attachment by stakes to the ground and which may be collapsed into a lightweight and compact configuration for carrying and storage purposes.

According to one aspect of the invention, a collapsible shelter includes a ground covering sheet having a first end, a second end, and a length between the first and second ends, a canopy having a first end, a second end, a length between the first and second ends, a first side, and a second side, the first end of the canopy being attached to the first end of the ground covering sheet, first and second elongated flexible rods each having two ends and a length between the two ends greater than the length of the ground covering sheet, means for attaching the first and second elongated flexible rods, respectively, at a plurality of locations along the first and second sides of the canopy, so as to hold the canopy in tension, means for attaching the ends of the first and second rods to the first and second ends of the ground covering sheet, so as to hold the ground covering sheet in tension, and means for maintaining the first and second rods in a spaced apart configuration.

According to another aspect of the invention, a collapsible shelter includes a ground cover for covering the ground, a wind and sun shield extending from a side of the ground cover and extending over at least half and less than the entire ground cover to form an interior of the shelter and allowing access to the interior of the shelter from at least three sides, and means for self supporting the shelter without attaching the shelter to the ground.

BRIEF DESCRIPTION OF THE DRAWING FIGURES

The invention will be described in greater detail with reference to the accompanying drawings in which like elements bear like reference numerals, and wherein:

FIG. 3 is a side view of a disassembled flexible support rod;

FIG. 4 is a side view of a disassembled cross rod; and

FIG. 5 is a top view of the disassembled sun shelter according to an alternative embodiment of the invention.

DETAILED DESCRIPTION

Figure 1:
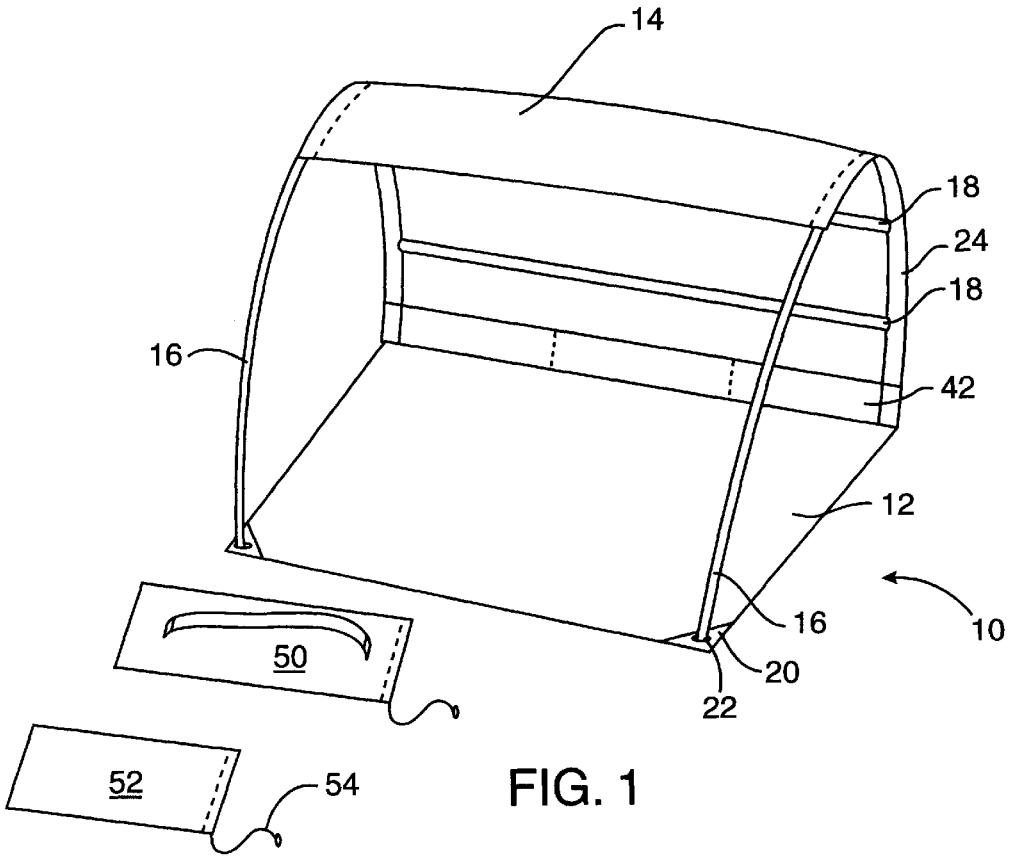
FIG. 1 is a perspective view of the assembled sun shelter according to the present invention.

The SUNSHADE 10 according to the present invention includes a floor 12 and a canopy 14 extending over the floor for protecting the occupants from sun and wind. The canopy 14 and the floor 12 are connected to each other along one end and the canopy extends over at least half of the floor and less than the entire floor. The SUNSHADE 10 also includes two long flexible support rods 16 and one or more, preferably three, shorter cross rods 18.

The floor 12 includes two front reinforced corners 20 having a large eyelet 22 formed in each of the front reinforced corners, and two back corners having an eyelet 23 formed in each of the back corners. The canopy 14 is formed with casings 24 extending along the sides of the canopy. The casings 24 are sized to receive the two flexible support rods 16. The casings 24 preferably include one or more openings 26 at an interior side of each of the casings which allows the cross rods 18 to be connected to the flexible support rods 16. As an alternative to providing the canopy 14 with casings 24 along the sides, the flexible support rods 16 may be attached to the sides of the canopy 14 by other means such as by clips or loops formed on the sides of the canopy.

The floor 12 and the canopy 14 are preferably formed of a woven material such as a heavy 100% cotton woven material which provides UV protection of SPF 50 or higher. Other materials which may be used include nylon, plastic, and other flexible organic or man-made materials. The floor 12 and the canopy 14 are preferably formed as one continuous sheet of material, however, they may also be formed of a plurality of sheets which have been sewn together.

As shown in FIG. 3, the flexible support rods 16 are formed from a plurality of rod segments and preferably includes an elastic cord 28 extending through and connecting each of the segments for ease of assembly. The ends of each of the rod segments are provided with mating portions which engage each other in a telescoping manner to provide a secure connection between segments. The segments which are on the ends of the flexible support rods 16 include end tips 30 which each include a reduced diameter pin member 32. The pin member 32 is sized to fit into the eyelets 22,23 while the remaining portion of the end tip 30 has a diameter which does not fit through the eyelets. The flexible support rods 16 are formed of a light weight flexible material such as plastic or aluminum. The flexible support rods 16 are preferably formed of pultruded plastic.

The short cross rods 18, as shown in FIG. 4, are also formed from a plurality of rod segments and include an elastic cord 34 extending through each of the segments for ease of assembly. Depending on the size of the SUNSHADE, different numbers of rod segments will be used to form one of the cross rods 18. For purposes of illustration, three segments have been shown. The cross rods 18 include end tips 36 which include a C-shaped end portion which is configured to be connected to one of the flexible support rods 16 at an intermediate portion of the support rod. The end tips 36 preferably provide a snap-on locking connection with the flexible support rods 16. One or more velcro flaps 38 are preferably be provided for each cross rod 18 which secure the canopy 12 to the cross rods at a central portion of the canopy. The velcro flaps 38 prevent the cross rods 16 from bowing away form the canopy 14. The cross rods 18 are preferably formed of a light weight, flexible, and strong material which may be the same as the material used for the flexible support rods 16. The flexible support rods 16 connected by the cross rods 18 form an arch shape which supports the canopy 14 in tension.

According to an alternative embodiment of the present invention, illustrated in FIG. 5, the canopy 14 may be provided with a series of casing 40 which are positioned perpendicular to the casings 24 at each of the openings 26. The cross rods 18 are inserted through the casings 40 and then attached to the flexible support rods 16 by the end tips 36.

The SUNSHADE 10 is preferably provided with a large carrying bag 50 for carrying the disassembled SUNSHADE. In addition, two smaller bags 52 may be provided for use as sand bags or pillows. The carrying bag 50 is preferably provided with one or more shoulder straps for carrying the bag and with extra space for carrying personal items.

The SUNSHADE may also include pockets 42 which are formed along the end of the canopy 14 where the canopy meets floor 12. These pockets 42 may be used to hold various accessory items for use at the beach such as suntan lotion and beverages. The SUNSHADE may additionally be provided with beverage holders (not shown) or other means for holding personal articles.

Figure 2:
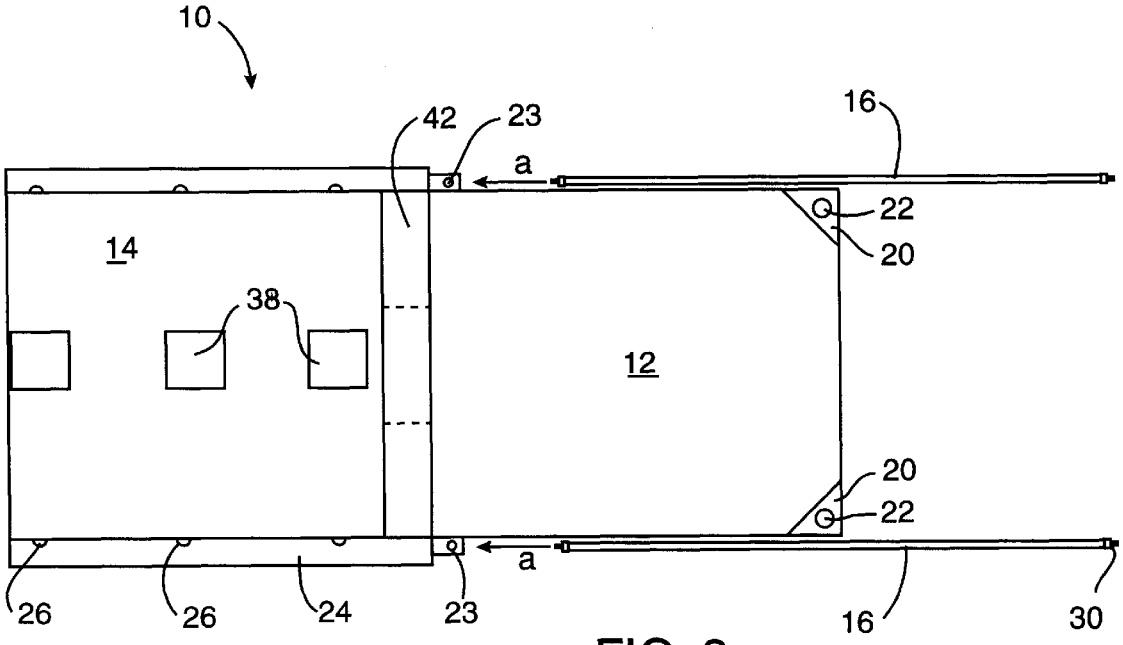
FIG. 2 is a top view of the disassembled sun shelter of FIG. 1.

The SUNSHADE 10 may be assembled according to the following steps. The floor 12 and the canopy 14 are unrolled on the ground as shown in FIG. 2. The flexible support rods 16 are assembled and inserted into the casings in the direction of the arrows a. One of the end tips 30 of each of the rods is inserted in each of the back eyelets 23. The cross rods 18 are then assembled and the end tips 36 of the cross rods 18 are attached to the flexible support rods 16 at the openings 26. If the SUNSHADE 10 is provided with casings 40 or velcro flaps 38 for the cross rods 18, then the cross rods must be inserted into the casings, or attached by the velcro flaps. The canopy 14 is then folded over the floor 12 so that it is covering the floor. The assembler then kneels or stands on the front edge of the floor 12 between the reinforced corners 22, bends both of the flexible support rods 16 upward at the same time inserting the end tips 30 into the front eyelets 22.

Once the SUNSHADE 10 has been assembled, the SUNSHADE will maintain its shape without the need for staking the structure to the ground. This is advantageous in areas where the ground is either too soft or too hard to allow the use of stakes. The SUNSHADE 10 provides plentiful shade while allowing access and view of the surroundings from three sides. In windy conditions, the small bags 52 may be filled with sand and the necks of the bags may be cinched with a drawstring 54 so that the bags may be placed on the floor of the SUNSHADE at the windward side as weights. These small bags 52 when filed with sand or other materials such as spare clothing may also be used as headrests.

The SUNSHADE according to the present invention has advantages over known structures in that the SUNSHADE is light weight, easily assembled by one person and does not require that stakes be driven into the ground to provide support. The SUNSHADE may be made in a variety of sizes and shapes such as one person, two person, and three person sizes, and rectangular, square, trapezoidal or other multi-sided shapes.

While the invention has been described in detail with reference to preferred embodiments thereof, it will be apparent to one skilled in the art that various changes can be made, and equivalents employed without departing from the spirit and scope of the invention.

What is claimed is:

1. A collapsible shelter comprising:

a ground covering sheet having a first end, a second end, and a length between the first and second ends;

a canopy having a first end, a second end, a length between the first and second ends, a first side, and a second side, the first end of the canopy being attached to the first end of the ground covering sheet and the canopy extends over at least half and less than the entire around cover;

first and second elongated flexible rods each having two ends and a length between the two ends greater than the length of the ground covering sheet; means for attaching the first and second elongated flexible rods, respectively, at a plurality of locations along the first and second sides of the canopy, so as to hold the canopy in tension;

means for attaching the ends of the first and second rods to the first and second ends of the ground covering sheet, so as to hold the ground covering sheet in tension; and means for maintaining the first and second rods in a spaced apart configuration;

wherein the means for attaching the first and second rods to the first and second ends of the ground covering sheet includes pins provided on the rods and openings provided in the ground cover sheet.

2. The collapsible shelter according to claim 1, wherein the first and second rods are each formed from a plurality of rod segments connected to one another.

3. The collapsible shelter according to claim 1, wherein the means for attaching the first and second rods along the first and second sides of the canopy includes casings formed along the first and second sides of the canopy.

4. The collapsible shelter according to claim 1, wherein the ground cover is substantially rectangular in shape.

5. The collapsible shelter according to claim 1, wherein means for maintaining the first and second rods in a spaced apart configuration includes an elongated member attached to both the first and second rods.

6. The collapsible shelter according to claim 5 wherein the elongated member is positioned perpendicular to both the first and second rods.

7. The collapsible shelter according to claim 6, wherein the elongated member is provided with a means for attaching a center portion of the elongated member to the canopy.

8. The collapsible shelter according to claim 1, wherein the means for maintaining the first and second rods in a spaced apart configuration includes at least two elongated members.

9. The collapsible shelter according to claim 1, wherein the canopy is provided with one or more pockets.

10. The collapsible shelter according to claim 1, wherein the canopy and the ground covering sheet are held in a tensioned position without attachment to the ground.

11. The collapsible shelter according to claim 1, further comprising two bags which may be filled with sand for extra stability in windy conditions, and a tote bag for carrying the shelter in a collapsed condition.

12. The collapsible shelter according to claim 1, wherein the canopy and the ground covering sheet are formed of fabric.

* * * * *